US008632079B2

(12) United States Patent
Ryan

(10) Patent No.: US 8,632,079 B2
(45) Date of Patent: Jan. 21, 2014

(54) SNOWSKATE AND A TIP FOR A SNOWSKATE

(76) Inventor: Gregory George Ryan, Revelstoke (CA)

( * ) Notice: Subject to any disclaimer, the term of this patent is extended or adjusted under 35 U.S.C. 154(b) by 485 days.

(21) Appl. No.: 12/878,093

(22) Filed: Sep. 9, 2010

(65) Prior Publication Data

US 2012/0061928 A1 Mar. 15, 2012

(51) Int. Cl.
*A63C 5/03* (2006.01)

(52) U.S. Cl.
USPC ..... 280/14.21; 280/14.22

(58) Field of Classification Search
USPC ..... 280/14.21, 14.22, 87.042
See application file for complete search history.

(56) References Cited

U.S. PATENT DOCUMENTS

| | | | | |
|---|---|---|---|---|
| 4,138,128 | A * | 2/1979 | Criss | 280/16 |
| 4,161,324 | A * | 7/1979 | Colvin | 280/14.25 |
| 4,163,565 | A * | 8/1979 | Weber | 280/14.21 |
| 4,221,394 | A * | 9/1980 | Campbell | 280/14.25 |
| 4,725,069 | A * | 2/1988 | Stampacchia et al. | 280/607 |
| 4,784,233 | A * | 11/1988 | Favors | 280/14.25 |
| 4,848,781 | A * | 7/1989 | Dykema et al. | 280/14.21 |
| 5,249,816 | A * | 10/1993 | Southworth | 280/14.25 |
| 5,820,154 | A * | 10/1998 | Howe | 280/602 |
| 6,158,752 | A * | 12/2000 | Kay | 280/87.042 |
| 6,419,248 | B1 * | 7/2002 | Kay | 280/87.042 |
| 6,702,315 | B2 * | 3/2004 | Barbieri et al. | 280/605 |
| 6,736,414 | B2 * | 5/2004 | Farrally-Plourde | 280/16 |
| 6,773,021 | B2 * | 8/2004 | Breuer et al. | 280/14.21 |
| 6,789,806 | B2 * | 9/2004 | Santa Cruz et al. | 280/14.21 |
| 6,857,641 | B2 * | 2/2005 | Bobrowicz | 280/14.21 |
| 6,866,273 | B2 * | 3/2005 | Barbieri et al. | 280/14.21 |
| 7,104,551 | B2 * | 9/2006 | Takahashi | 280/14.25 |
| 7,178,814 | B2 * | 2/2007 | Mash | 280/87.042 |
| 7,237,784 | B1 * | 7/2007 | Monteleone | 280/87.042 |
| 8,256,779 | B1 * | 9/2012 | Johnson | 280/87.042 |
| 2002/0008360 | A1 * | 1/2002 | Ellington | 280/14.21 |
| 2002/0043774 | A1 * | 4/2002 | Chou | 280/7.12 |
| 2002/0070515 | A1 * | 6/2002 | Barbieri et al. | 280/14.21 |
| 2002/0158430 | A1 * | 10/2002 | Farcot et al. | 280/14.21 |
| 2002/0190501 | A1 * | 12/2002 | Barbieri et al. | 280/604 |
| 2003/0085537 | A1 * | 5/2003 | Breuer et al. | 280/14.21 |
| 2003/0160404 | A1 * | 8/2003 | Bobrowicz | 280/14.21 |
| 2003/0193168 | A1 * | 10/2003 | Chou | 280/607 |
| 2007/0170677 | A1 * | 7/2007 | Wake | 280/87.042 |
| 2009/0179391 | A1 * | 7/2009 | Ota | 280/14.22 |
| 2012/0061928 | A1 * | 3/2012 | Ryan | 280/14.21 |

FOREIGN PATENT DOCUMENTS

DE 3541682 A1 5/1987

OTHER PUBLICATIONS

Requisition Re Canadian Patent Application No. 2,714,244, Canadian Patent Office, Mailed May 17, 2012.

* cited by examiner

*Primary Examiner* — Jeffrey J Restifo
(74) *Attorney, Agent, or Firm* — Quarles & Brady LLP

(57) ABSTRACT

A snowskate, comprising: an upper deck having a first tip at one end of the snowskate, the upper deck having an upper surface for supporting a user while riding the snowskate; a lower deck having a second tip at the one end, the lower deck having a lower surface for contacting snow upon which the snowskate is ridden by the user; and, one or more trucks for mounting the upper deck above the lower deck; wherein the second tip extends above the first tip at the one end to thereby reduce the snow from gathering between the upper and lower decks when the snowskate is ridden in the direction of the one end.

16 Claims, 6 Drawing Sheets

SNOWSKATE AND A TIP FOR A SNOWSKATE

FIELD OF THE INVENTION

This invention relates to the field of snowskates, and more specifically, to a bi-deck snowskate configured for use in varied snow conditions.

BACKGROUND

A snowskate is a type of snowboard that does not have bindings. There are generally three kinds of snowskates: powderskates, single deck snowskates, and bi-deck snowskates.

A powderskate is a bindingless snowboard that is meant for use in powder snow conditions. A powderskate may include a rubber traction pad applied to a snowboard deck instead of bindings. It may include a rope and handle that a rider or user pulls on to keep pressure on their feet and hence on the rubber traction pad and snowboard deck. Powderskates are available from several manufacturers (e.g., Noboard™, etc.).

A single deck snowskate includes a deck that is generally composed of either a laminated wood core with a P-Tex™ base or of solid plastic. On the top surface of the deck is a traction surface which may be composed of a foam grip material. The base of the deck may be grooved for tracking in the snow and locking onto trails. The deck is generally not equipped with a metal edge or leash: Single deck snowskates are generally ridden in backyard snowskate parks. They can be ridden down hills with practise but are not suitable for mountain or resort riding due to the lack of control on steep slopes and hard packed snow. Single deck snowskates are available from several manufacturers (e.g., Premier™, etc.).

A bi-deck snowskate has an upper skateboard style deck raised over a lower ski or snowboard style deck. The upper deck may be a skateboard deck built for winter use while the lower deck may have the same construction as a snowboard having a wood core, metal edges, and a P-Tex™ base. Connecting the upper and lower decks are snowskate trucks which may be non-articulated (or stiff) or articulated to offer a more consistent flex of the lower deck. The upper deck upon which a rider or user stands is equipped with a traction surface such as foam grip. The lower deck is typically narrower than the upper deck to allow the bi-deck snowboard to be controlled by a rider or user in a manner similar to that of a conventional snowboard having bindings. The leverage the rider or user gets by pressing down with his or her feet on a side of the upper board is similar to the effect that is achieved by lifting on the bindings of a conventional snowboard to initiate a turn. Bi-deck type snowskates provide riders or users with the highest level of control and are intended for mountain riding. Bi-deck snowskates are available from several manufacturers (e.g., Ralstont™, etc.).

One problem with current snowskates is that they are not suitable for riding in all snow conditions. That is, in snow ranging from deep powder to hard packed icy conditions. In particular, powderskates and single deck snowskates may be ridden in powder but are difficult to ride on hard packed snow. On the other hand, current bi-deck snowskates may be ridden on hard packed snow but tend to sink in powder.

A need therefore exists for an improved snowskate. Accordingly, a solution that addresses, at least in part, the above and other shortcomings is desired.

SUMMARY OF THE INVENTION

According to one aspect of the invention, there is provided a snowskate, comprising: an upper deck having a first tip at one end of the snowskate, the upper deck having an upper surface for supporting a user while riding the snowskate; a lower deck having a second tip at the one end, the lower deck having a lower surface for contacting snow upon which the snowskate is ridden by the user; and, one or more trucks for mounting the upper deck above the lower deck; wherein the second tip extends above the first tip at the one end to thereby reduce the snow from gathering between the upper and lower decks when the snowskate is ridden in the direction of the one end.

In the above snowskate, the first and second tips may be separated by a gap formed therebetween and the gap may be sized further reduce the snow from gathering between the upper and lower decks when the snowskate is ridden. The upper deck may have a lower surface for contacting the snow when the lower deck is submerged in the snow when ridden to thereby support the snowskate in the snow. The lower surface of the upper deck may be a gliding surface to reduce friction between the lower surface of the upper deck and the snow when the lower surface of the upper deck contacts the snow. The gliding surface may be a P-Tex™ base. The upper surface of the upper deck may be concave. The upper deck may be wider than the lower deck. The snowskate may further include a grip pad mounted on the upper surface of the upper deck. The lower surface of the lower deck may be a gliding surface and the gliding surface may be a P-Tex™ base. And, an other end of the snowskate and the one end of the snowskate may have a same configuration.

BRIEF DESCRIPTION OF THE DRAWINGS

Features and advantages of the embodiments of the present invention will become apparent from the following detailed description, taken in combination with the appended drawings, in which.

It will be noted that throughout the appended drawings, like features are identified by like reference numerals.

DETAILED DESCRIPTION OF THE EMBODIMENTS

In the following description, details are set forth to provide an understanding of the invention. In some instances, certain structures and techniques have not been described or shown in detail in order not to obscure the invention.

According to one embodiment of the invention, there is provided a bi-deck snowskate that is configured for riding in varied snow conditions. The snowskate has a large top or upper deck, two primary gliding surfaces, and a lower deck or ski length that allows a rider or user to access all necessary positions over the ski's edge from tip to tail depending on snow conditions or terrain while limiting friction and increasing surface area. The snowskate provides for improved performance in powder, improved groomer control, and improved stance options on all terrain that may be encountered in a run simply by a rider adjusting the position of his or her feet. These advantages are provided by the increased length of the top deck made possible by the snowskate of the present invention. The increased length of the upper deck accommodate rider stances necessary for different snow conditions allowing the rider to be over the most effective part of the lower deck's or ski's edge depending on the snow condition.

Figure 1:
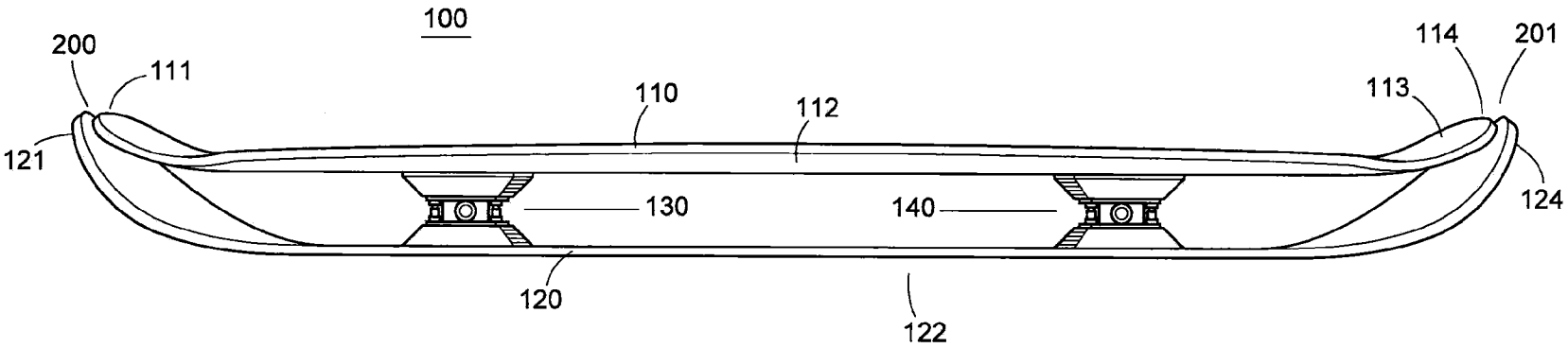
FIG. 1 is a left side view illustrating a snowskate in accordance with an embodiment of the invention.
Figure 2:
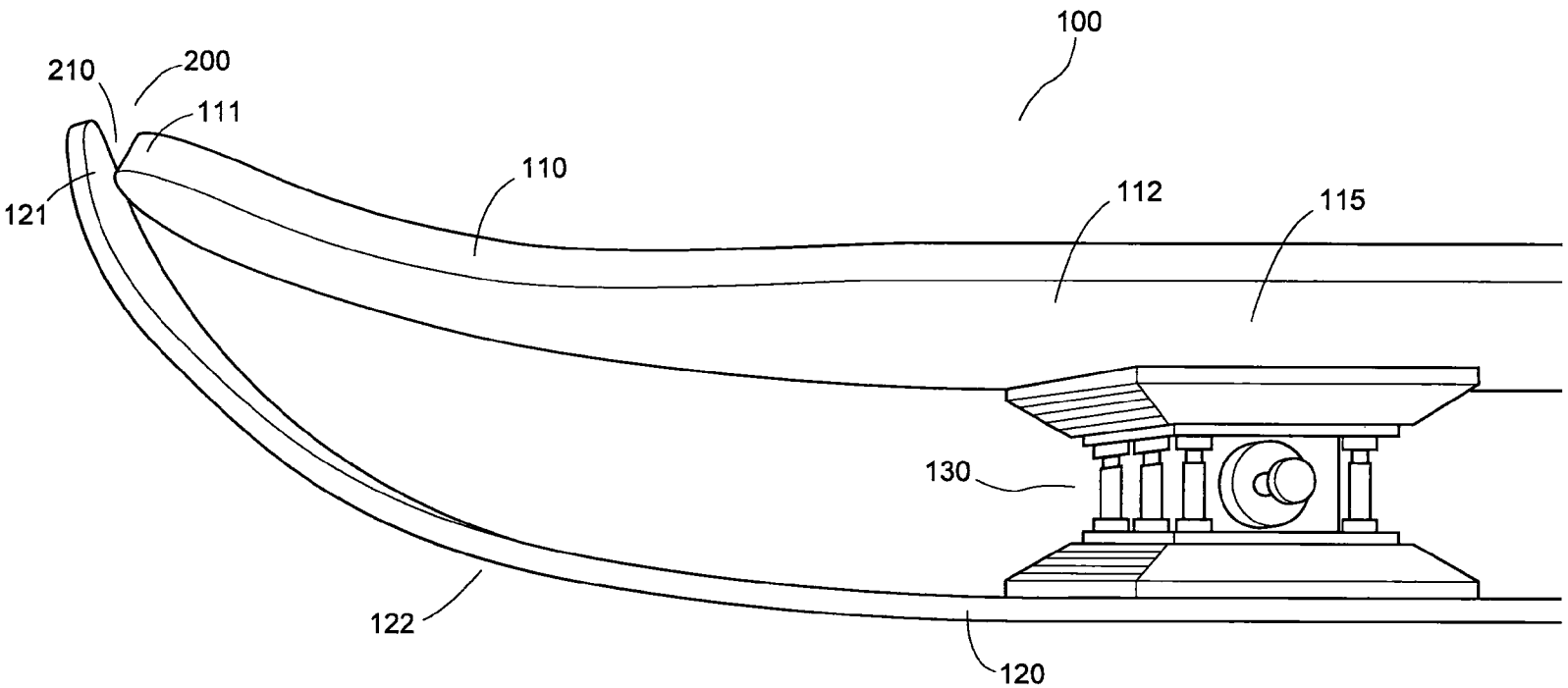
FIG. 2 is a left side detail view illustrating a tip of the snowskate of FIG. 1 in accordance with an embodiment of the invention.
Figure 3:
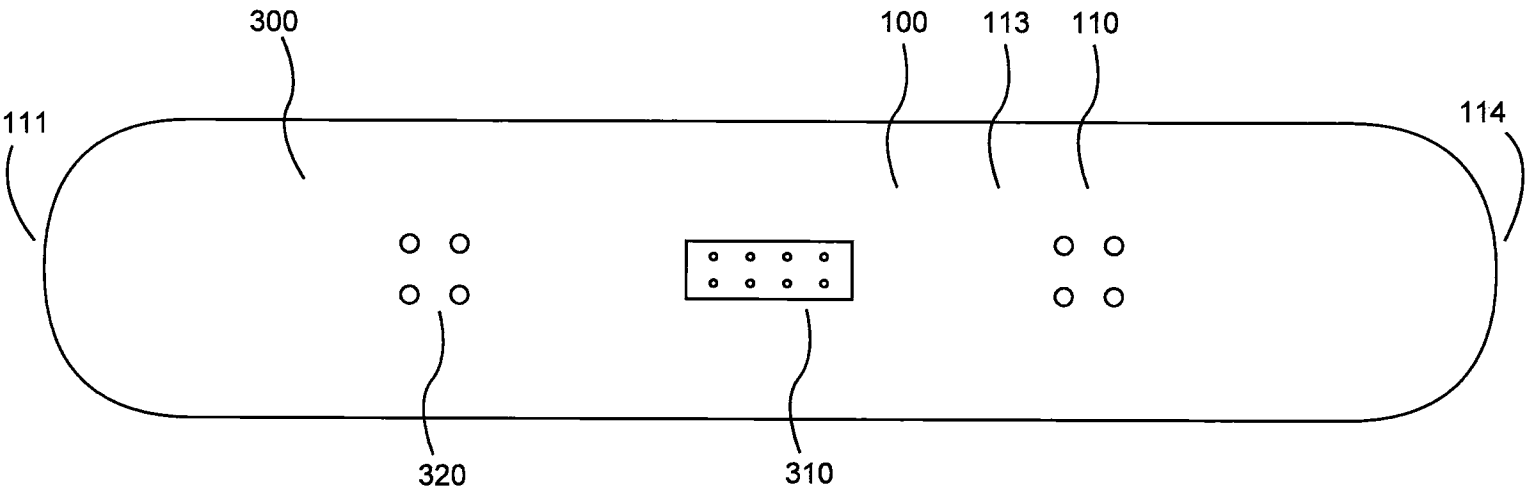
FIG. 3 is a top view illustrating the snowskate of FIG. 1 in accordance with an embodiment of the invention.
Figure 4:
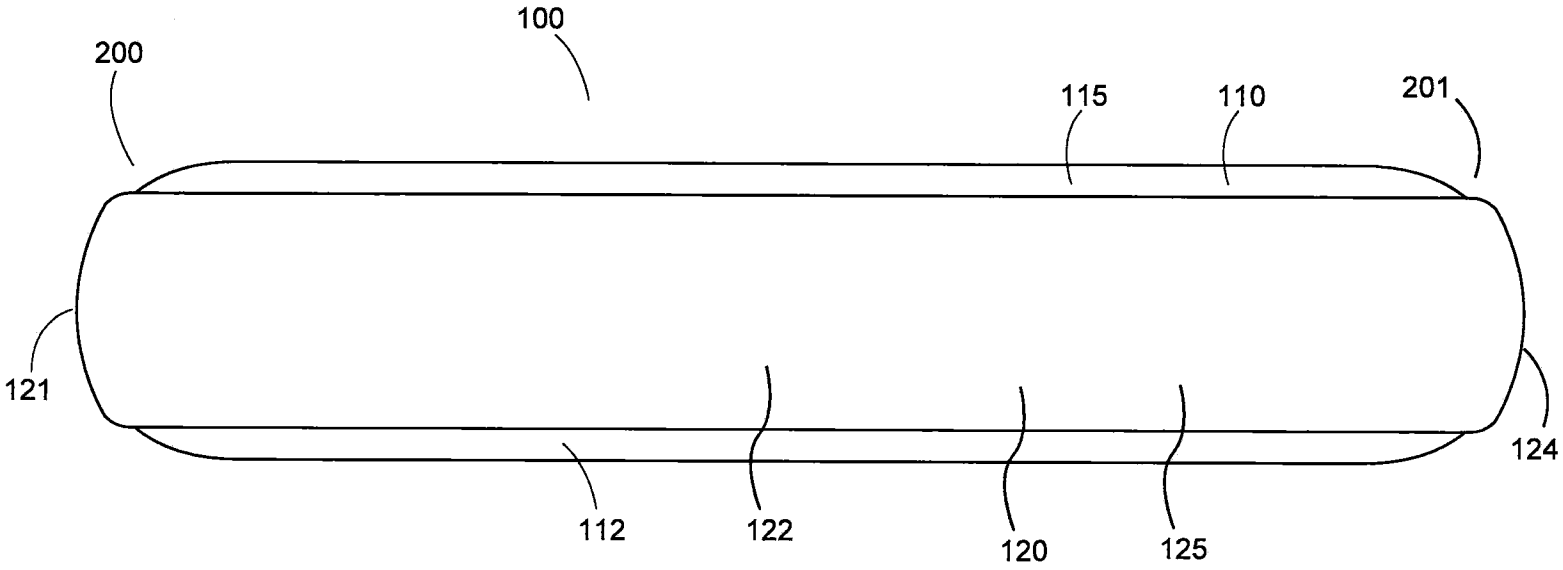
FIG. 4 is a bottom view illustrating the snowskate of FIG. 1 in accordance with an embodiment of the invention.
Figure 5:
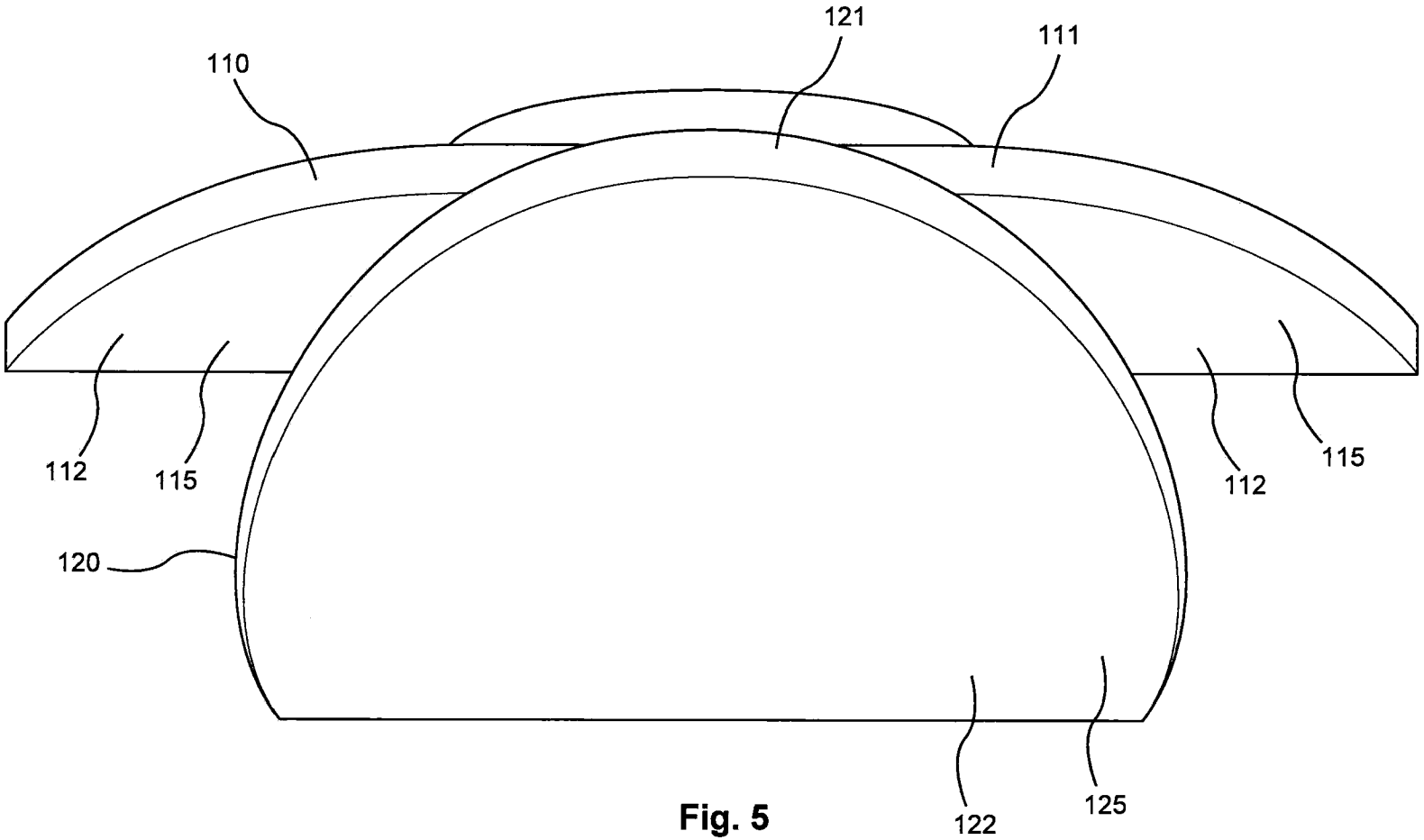
FIG. 5 is a front view illustrating the snowskate of FIG. 1 in accordance with an embodiment of the invention; and, FIG. 6 is a top perspective view illustrating the snowskate of FIG. 1 in use in accordance with an embodiment of the invention.
Figure 6:
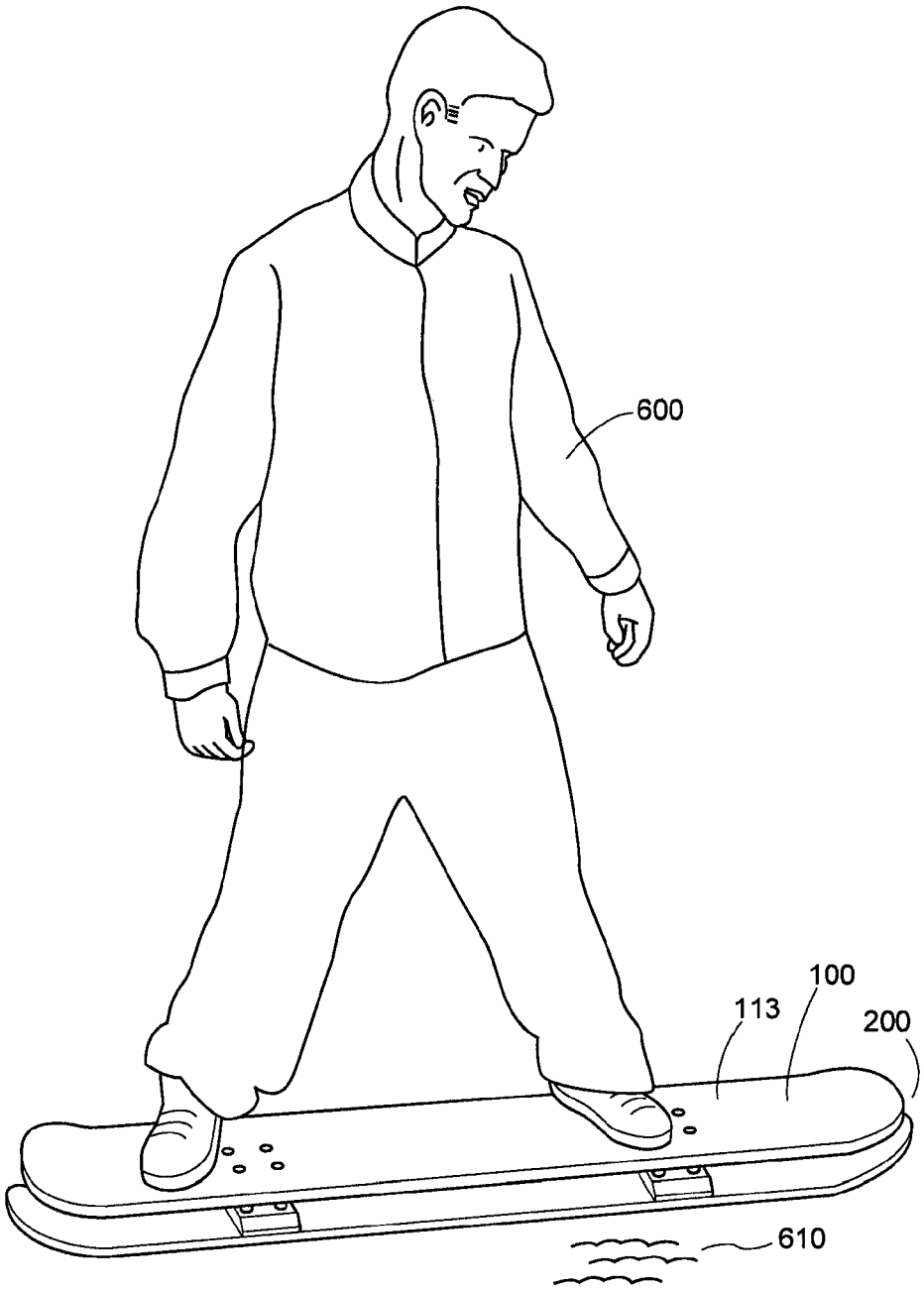

FIG. 1 is a left side view illustrating a snowskate 100 in accordance with an embodiment of the invention. FIG. 2 is a left side detail view illustrating an end or tip 200 of the snowskate 100 of FIG. 1 in accordance with an embodiment of the invention. FIG. 3 is a top view illustrating the snowskate 100 of FIG. 1 in accordance with an embodiment of the invention. FIG. 4 is a bottom view illustrating the snowskate 100 of FIG. 1 in accordance with an embodiment of the invention. FIG. 5 is a front view illustrating the snowskate 100 of FIG. 1 in accordance with an embodiment of the invention. And, FIG. 6 is a top perspective view illustrating the snowskate 100 of FIG. 1 in use in accordance with an embodiment of the invention.

According to one embodiment, the snowskate 100 has a top or upper deck 110 coupled to a ski or lower deck 120 by two trucks 130, 140. The decks 110, 120 are for riding on snow 610 (in most cases) by a rider or user 600. The tips 111, 121 of the two decks 110, 120 don't meet at the tip 200 of the snowskate 100. Rather, the two tips 111, 121 almost meet and hence form a unique snowskate tip 200. The tips 111, 121 are separated by a gap 210 which allows the decks 110, 120 to flex without making contact in most cases. According to one embodiment, the tip 121 of the lower deck 120 rises or extends above the tip 111 of the upper deck 110. According to one embodiment, the lower deck 120 is longer than the upper deck 110. According to one embodiment both ends or tip and tail or tips 200, 201 of the snowskate 100 are similarly configured. According to one embodiment, the gap 210 is approximately 1 cm wide. According to one embodiment, the tip 121 of the lower deck 120 extends above the tip 111 of the upper deck 110 by approximately 1 cm. According to one embodiment, the tip 121 of the lower deck 120 extends at least to the level of the tip 111 of the upper deck 110.

The snowskate 100 allows a rider 600 to ride in virtually all snow conditions in a single decent on a skiable hill with no bindings. The ability to deal with different snow conditions in one descent is accomplished by the rider 600 adjusting his stance on the snowskate 100 to take advantage of the unique tip 200 and other features of the snowskate 100. For example, the stance (i.e., placement of the feet) of the rider 600 would be forward on the snowskate for the groomed runs or hard packed snow and the stance of the rider 600 would be farther back on the snowskate 100 for the powder runs. The change in a rider's stance for different snow conditions activates the different features of the snowskate's two decks 110, 120 and allows the tip 200 to be effective by manipulating the snowskate's two gliding surfaces 112, 122.

The upper deck 110 of the snowskate 100 is equipped with a traction pad, grip tape, foam grip, or grip pad 300 to provide traction for a rider's feet. The grip pad 300 provides the rider 600 with a surface to stand on that provides traction. The grip pad 300 is applied to the upper deck 110 by self adhesion (e.g., the bottom surface of the grip pad 300 has an adhesive applied thereto for securing the pad 300 to the upper surface 113 of the upper deck 110). According to one embodiment, studded or spiked pads 310 are also provided on the upper surface 113 of the upper deck 110. The rider's feet will sink into the foam based grip pad 300 and the spiked pads 310 will stick into the rider's boots to provide traction. Grip and spiked pads 300, 310 are available from several manufacturers (e.g., Xtremegrip™, FS Original Foam Grip™, etc.). The grips 300, 310 may be purchased in bulk and cut to fit the upper deck 110. Selection of grips 300, 310 may be made based on rider preference. The grips 300, 310 allow the rider 600 to control the board without the worry that their feet will be slide around.

The upper deck 110 may be similar to an oversized skateboard style riding platform. It is mounted over the lower deck 120 and is used to gain edge control over the lower deck 120. According to one embodiment, the upper deck 110 is wider than the lower deck 120 and has a concave upper surface 113 and raised tips 111, 114 (like a skateboard) which may be the same at both ends (or tip and tail) of the deck 110. The upper deck 110 may be made or pressed in several plies of wood (i.e., laminated) or with another type of moulded material for weight reduction. The upper deck 110 is oversized in length when compared to previous bi-deck snowskates. Accordingly to one embodiment, the upper deck 110 may have a length of approximately 140 cm. The extended length of the upper deck 110 allows a rider 600 to position him or herself over the correct portion of the lower deck 120 to gain maximum edge control. This length also allows riders to use any stance width that they need or desire and to change stances in seconds. The concave upper surface 113 provides additional traction and edge initiation for stopping and turning.

The lower surface 115 of the upper deck 110 is provided with a fully waxable P-Tex™ base (i.e., a porous, plastic (polyethylene) material that is saturated with wax) that is applied during the pressing or moulding process to create a gliding surface 112 on the lower surface 115 of the upper deck 110. When the lower deck 120™ is fully submerged in snow 610 during powder riding conditions, the lower surface 115 of the upper deck 100 will become the primary gliding surface for the snowskake 110 for short periods of time when the lower deck 120 is submerged in the snow. This significantly reduces friction from the snow and allows the tips 200, 201 of the snowskate to operate effectively. In particular, the upper deck 110 is matched to the lower deck 120 to create the tips 200, 201. That is, the tips 111, 114 of the upper deck 110 are aligned with the tips 121, 124 of the lower deck 120 such that the actual riding surface (i.e., the upper surface 113 of the upper deck 110) of the upper deck 110 is at or below the tips 121, 124 of the lower deck 120. The gliding surface 112 on the lower surface 115 of the upper deck 110 helps to pull the tip 121 of the lower deck 120 out of the snow 610 when it becomes submerged therein.

Trucks 130, 140 are used to connect or couple the upper deck 110 to the lower deck 120. The trucks 130, 140 may be bolted or screwed to the upper and lower decks 110, 120. Inserts or holes 320 for receiving the bolts or screws may be provided in the upper and lower decks 110, 120. The trucks 130, 140 transfer the edging initiated on the upper deck 110 by the rider to the lower deck 120. The trucks 130, 140 may be rigid (or solid) or flexible (or articulated (e.g., via an axle)) to help initiate turns. Selection of trucks 130, 140 may be made based on rider preference. Flexible trucks provide for consistent flex in the lower deck allowing more consistent edge hold while rigid trucks tend to keep the lower deck stiff. Trucks 130, 140 are available from several manufacturers (e.g., Rocker Truck™, etc.).

The lower deck 120 is used to control the snowskate 100 at all times even when in powder snow. The lower deck 120 may be constructed in several layers usually including P-Tex™, fiber glass, and wood, but other materials may also be used to gain weight reduction and stiffen or soften the flex of the deck 120. The materials are then pressed to the necessary shape for the lower deck 120 so that the tips 200, 201 are created when it is combined with the upper deck 110. The lower surface 125 of the lower deck 120 is provided with a fully waxable P-Tex™ base (i.e., a porous, plastic (polyethylene) material that is saturated with wax) that is applied during the pressing or moulding process to create a gliding surface 122 on the lower surface 125 of the lower deck 120.

The lower surface 125 of the lower deck 120 is the primary gliding surface in all riding situations until the lower deck 120 is completely submerged in powder snow. When submerged in powder snow, the lower surface 125 becomes the secondary gliding surface for short periods of time until the upper deck 110 aids in pulling the tip 121 up out of the snow as described above. Even though the tips 121, 124 of the lower deck 120 rise or extend above those 111, 114 of the upper deck 110, they can still become submerged in snow in which case the lower surface 115 of the upper deck 110 acts similar to the secondary hull of a hydrofoil.

The rise of the tips 121, 124 of the lower deck 120 above those 111, 114 of the upper deck 110 leaves little or no room for the snow to get between the upper deck 110 and the lower deck 120 thereby helping to prevent the nose or tip 121 of the lower deck 120 from being dragged down into the snow 610.

The lower deck 120 may have a side cut or hour glass shape (e.g., 6 inches at the centre and 7.25 inches at the tips 121, 124) to provide for improved edge control on groomed runs. The lower deck 120 may be thinner than the upper deck 110 thereby allowing the upper deck 110 to control the lower deck 120 through the trucks 130, 140. The length and width of the lower deck 120 may be varied in coordination with the length and width of the upper deck 110 such that the configuration of the tips 200, 201 is maintained.

According to one embodiment, the width of the upper deck 110, its shape, its length, and its degree of concavity may be varied. For example, the tips 111, 114 of the upper deck 100 may be thinner to further reduce friction. Lighter or different materials and higher performance gliding surfaces 112, 122 may also be employed.

According to one embodiment, different sizes and shapes of trucks 130, 140 may be used. For example, higher rising trucks 130, 140 may be used for improved carving on groomed terrain. Different shaped (e.g., circles or rounded) trucks may be used to reduce friction and clearing of snow between the upper and lower decks 110, 120. Trucks with adjustable dampening may be used to allow a rider to adjust stiffness of movement according to personal preference or terrain or snow conditions.

According to one embodiment, the shape and length of the lower deck 120 may be varied in accordance with the upper deck 110. For example, variations in tip width, waist width, and the amount of side cut may be made. In addition, the rise of the tip 121 of the lower deck 120 above the tip 111 of the upper deck 110 may vary (e.g., it may be higher) for better powder performance or the gap 210 between the tips 111, 121 may be varied to give the lower deck 120 more movement according to different terrain and snow conditions. The lower deck 120 may have more or less flex according to rider preference or to give a better feel under certain conditions. Other changes to lighten and make the lower deck 100 more durable may also be made.

Thus, according to one embodiment, there is provided a snowskate 100, comprising: an upper deck 110 having a first tip 111 at one end 200 of the snowskate 100, the upper deck 110 having an upper surface 113 for supporting a user 600 while riding the snowskate 100; a lower deck 120 having a second tip 121 at the one end 200, the lower deck 120 having a lower surface 125 for contacting snow 610 upon which the snowskate 100 is ridden by the user 600; and, one or more trucks 130, 140 for mounting the upper deck 110 above the lower deck 120; wherein the second tip 121 extends above the first tip 111 at the one end 200 to thereby reduce the snow 610 from gathering between the upper and lower decks 110, 120 when the snowskate 100 is ridden in the direction of the one end 200.

In the above snowskate 100, the first and second tips 111, 121 may be separated by a gap 210 formed therebetween and the gap 210 may be sized (e.g., minimized) to further reduce the snow 610 from gathering between the upper and lower decks 110, 120 when the snowskate 100 is ridden. The upper deck 110 may have a lower surface 115 for contacting the snow when the lower deck 120 is submerged in the snow 610 when ridden to thereby support the snowskate 100 in the snow 610. The lower surface 115 of the upper deck 110 may be a gliding surface 112 to reduce friction between the lower surface 115 of the upper deck 110 and the snow 610 when the lower surface 115 of the upper deck 110 contacts the snow 610. The gliding surface 112 may be a P-Tex™ base. The upper surface 113 of the upper deck 110 may be concave. The upper deck 110 may be wider than the lower deck 120. The snowskate 100 may further include a grip pad 300 mounted on the upper surface 113 of the upper deck 110. The lower surface 125 of the lower deck 120 may be a gliding surface 122 and the gliding surface 122 may be a P-Tex™ base. And, an other end 201 of the snowskate 100 and the one end 200 of the snowskate 100 may have a same configuration.

The above embodiments may contribute to an improved snowskate 100 and may provide one or more advantages. First, the snowskate 100 allows a rider 600 to ride in virtually all snow conditions on one board. This is possible because of the snowskate's tips 200, 201 which provide protection from submersion in the snow 610. Second, the tips 200, 201 of the snowskate 100 help to keep snow from getting between the upper deck 110 and the lower deck 120 which improves performance in powder. Third, the length of the upper deck 110 and traction pad 300 provides a broad range of stance options to the rider thereby allowing for proper positioning over the lower deck 120 depending on snow conditions. Current snowskates do not provide such a large traction pad surface as they are generally designed for one specific application (i.e., powder or groomed snow but not both). As such, their traction pads are only provided in the area of the board needed for riding in the type of snow the board is designed for. Fourth, configuration of the tips 200, 201 of the snowskate 100, in particular the rising of the tips 121, 124 of the lower deck 120 above the tips 111, 114 of the upper deck 110, reduces snow from getting between the lower and upper decks 110, 120 and dragging the lower deck 120 down. Fifth, the P-Tex™ base 112 on the lower surface 115 of the upper deck 110 provides a secondary gliding surface 112 for increased floatation in powder and proper stance position over the lower deck 120. Sixth, a user or rider 610 may ride the snowskate 100 in virtually all types of snow conditions simply by adjusting his or her stance on the upper deck 110. For example, in powder snow, the rider 610 may stand more toward the uphill end of the snowskate 100. In hard parked snow, the rider 610 may stand more toward the centre of the snowskate 100. Seventh, the snowskate 100 may be used as a crossover product in the ski and snowboard industry. For example, the snowskate 100 allows riders of traditional snowskates to ride powder and allows riders of powderskates to ride groomed runs under control. The snowskate 100 eliminates the need for a rider to choose which board to ride or what terrain he or she is going to ride in advance as it allows a rider to ride in virtually all snow conditions.

The embodiments of the invention described above are intended to be exemplary only. Those skilled in this art will understand that various modifications of detail may be made to these embodiments, all of which come within the scope of the invention.

What is claimed is:

1. A snowskate, comprising:

an upper deck having a first tip at one end of the snowskate, the upper deck having an upper surface for supporting a user while riding the snowskate;

a lower deck having a second tip at the one end, the lower deck having a lower surface for contacting snow upon which the snowskate is ridden by the user; and, one or more trucks for mounting the upper deck above the lower deck;

wherein the second tip extends above the first tip at the one end to thereby reduce the snow from gathering between the upper and lower decks when the snowskate is ridden in the direction of the one end;

wherein the upper deck has a lower surface for contacting the snow when the lower deck is submerged in the snow when ridden to thereby support the snowskate in the snow, and wherein the upper deck is wider than the lower deck.

2. The snowskate of claim 1 wherein the first and second tips are separated by a gap formed therebetween and wherein the gap is sized to further reduce the snow from gathering between the upper and lower decks when the snowskate is ridden.

3. The snowskate of claim 2 wherein the lower surface of the upper deck is a gliding surface to reduce friction between the lower surface of the upper deck and the snow when the lower surface of the upper deck contacts the snow.

4. The snowskate of claim 3 wherein the gliding surface is a P-TEX™ base.

5. The snowskate of claim 1 wherein the upper surface of the upper deck is concave.

6. The snowskate of claim 1 and further comprising a grip pad mounted on the upper surface of the upper deck.

7. The snowskate of claim 1 wherein the lower surface of the lower deck is a gliding surface and wherein the gliding surface is a P-TEX™ base.

8. The snowskate of claim 1 wherein an other end of the snowskate and the one end of the snowskate have a same configuration.

9. A tip for a snowskate, comprising:

a first tip of an upper deck at one end of the snowskate, the upper deck having an upper surface for supporting a user while riding the snowskate; and, a second tip of a lower deck at the one end, the lower deck having a lower surface for contacting snow upon which the snowskate is ridden by the user;

wherein the upper deck is mounted above the lower deck by one or more trucks; and, wherein the second tip extends above the first tip at the one end to thereby reduce the snow from gathering between the upper and lower decks when the snowskate is ridden in the direction of the one end;

wherein the upper deck has a lower surface for contacting the snow when the lower deck is submerged in the snow when ridden to thereby support the snowskate in the snow, and wherein the upper deck is wider than the lower deck.

10. The tip of claim 9 wherein the first and second tips are separated by a gap formed therebetween and wherein the gap is sized to further reduce the snow from gathering between the upper and lower decks when the snowskate is ridden.

11. The tip of claim 10 wherein the lower surface of the upper deck is a gliding surface to reduce friction between the lower surface of the upper deck and the snow when the lower surface of the upper deck contacts the snow.

12. The tip of claim 11 wherein the gliding surface is a P-TEX™ base.

13. The tip of claim 9 wherein the upper surface of the upper deck is concave.

14. The tip of claim 9 wherein a grip pad is mounted on the upper surface of the upper deck.

15. The tip of claim 9 wherein the lower surface of the lower deck is a gliding surface and wherein the gliding surface is a P-TEX™ base.

16. The tip of claim 9 wherein an other end of the snowskate and the one end of the snowskate have a same configuration.

* * * * *